US008166965B2

(12) United States Patent
Miles et al.

(10) Patent No.: US 8,166,965 B2
(45) Date of Patent: May 1, 2012

(54) FIREPLACE INSERT

(75) Inventors: Martin Miles, West Vancouver (CA); Garry Miles, West Vancouver (CA); Byron Book, North Vancouver (CA); John Stevens, Delta (CA)

(73) Assignee: Miles Industries, Ltd., North Vancouver, British Columbia (CA)

( * ) Notice: Subject to any disclaimer, the term of this patent is extended or adjusted under 35 U.S.C. 154(b) by 2040 days.

(21) Appl. No.: 11/153,681

(22) Filed: Jun. 16, 2005

(65) Prior Publication Data

US 2006/0283442 A1 Dec. 21, 2006

(51) Int. Cl.
*F24B 1/188* (2006.01)

(52) U.S. Cl. ..... 126/523; 126/512

(58) Field of Classification Search ..... 126/523, 126/531, 528, 520, 544, 512
See application file for complete search history.

(56) References Cited

U.S. PATENT DOCUMENTS 4,230,092 A * 10/1980 Henriques ..... 126/527
4,913,131 A * 4/1990 Petersen ..... 126/544
5,191,877 A 3/1993 Shimek et al.
5,752,500 A 5/1998 Jamieson et al.
6,029,655 A 2/2000 Hussong et al.
6,116,232 A 9/2000 Valters et al.

OTHER PUBLICATIONS

Heat-N-Glo; Rekindler—Sealed Combustion Masonry and ZC Gas Insert Specification and Prilce List; Sep. 2004.
Heat-N-Glo; Installers Guide; 2003.
CFM Specialty Home Products; Vermont Castings Installation Instructions & Homeowners Manual; 2004.
CFM Specialty Home Products; Majestic Fireplaces Homeowner's Installation and Operating Manual; 2004.

* cited by examiner

*Primary Examiner* — Alfred Basichas
(74) *Attorney, Agent, or Firm* — Smiths IP

(57) ABSTRACT

The invention provides an insert assembly to convert an existing fireplace hearth into a gas burning fireplace and a method for installing the insert assembly while conveying the appearance of a wood burning fireplace. The insert assembly comprises legs removably attachable to the base of the firebox for allowing the insert to be installed higher into the hearth. The inner walls of the firebox are colored so as to camouflage the structure of the assembly in the hearth and a decorative fender mimics a wood burning grill. Where the insert includes a heat exchanger, a guide plate is provided at the top of the insert to ensure that air exiting the heat exchange outlet at the top of the insert is directed into the room.

28 Claims, 11 Drawing Sheets

FIREPLACE INSERT

FIELD OF THE INVENTION

This invention relates to gas inserts designed to be retrofitted into fireplaces.

BACKGROUND OF THE INVENTION

It is known to provide gas fireplace inserts that are designed to be retrofitted into wood burning fireplaces. Examples of such inserts are disclosed in U.S. Pat. No. 5,191,877 to Shimek, U.S. Pat. No. 5,752,500 to Jamieson et al., U.S. Pat. No. 6,029,655 to Hussong et al. and U.S. Pat. No. 6,116,232 to Valters et al.

The use and installation of gas fireplace inserts are constrained by certain conditions. Inserts of the sealed combustion type are often provided with an integral heat exchange passageway around the firebox into which room air is drawn in, heated and expelled back into the room. The pathway is defined by an outer wall of the insert that is spaced from the top and back walls of the firebox. Circulation of air through the pathway is often ensured by a blower mounted beneath or to the rear of the firebox. Legs or brackets supporting the firebox base provide a gap under the firebox to accommodate the gas piping and controls (and sometimes a blower) and to define the bottom part of the pathway. Heated air is exhausted forward into the room from the top of the firebox, immediately above the window of the insert.

Gas fireplace inserts should provide an aesthetically pleasing appearance. One means of doing so is to mask the gap between the insert and the inner walls of the hearth of the original fireplace. This is accomplished by providing trim designed to overlap the outer edges of the fireplace mouth (and sometimes the louvers and original fireplace facing). The trim connects to the insert such that the insert window lies generally in the plane of the fireplace mouth.

In order to provide as large a window as possible while still accommodating the outer dimensions of the insert, the insert is made as large as possible while still allowing it to be slid to the back of the hearth. As a result, there is usually very little clearance (sometimes as little as half an inch) between the top of the insert and the bottom of the lintel, baffle or smoke curtain that is provided in many wood burning fireplaces. This tight fit presents challenges to installers who are required to fit ducting or liners from the flue onto the insert's vent connector. In some cases, installers are known to remove the smoke curtain, portions of the masonry wall of the fireplace and the metal floor of manufactured fireplaces in order to install inserts. Such modifications to the fireplace stand the risk of running afoul of building codes and gas appliance restrictions.

Because of the use of trim that extends from the edges of the window of the insert to past the edges of the fireplace mouth, there is often a disproportionate amount of trim in relation to the surface area of the window. This may detract from the appearance of the fireplace by making the window look small in proportion to the overall fireplace. Various approaches are taken to minimize such effect. These include maximizing the size of the window within the constraints mentioned above, as well as providing various decorative elements and treatments to the facing. This "porthole" effect is compounded by the fact that a portion of the front area of the insert is taken up by the outlet of the heat exchange passageway, leaving less space available for the window.

As inserts are seated on the floor inside the hearth with a glass panel in the plane of the fireplace mouth, this constrains how far into the fireplace hearth the insert can be seated. This usually makes the insert look significantly shallower than the original fireplace.

It is an object of the present invention to provide a fireplace insert that offers an improved physical appearance to the installed insert. More particularly it is an object of the invention to provide an insert that looks larger, sits deeper, and is less distinguishable as an insert than the inserts of the prior art.

It is a more particular object of the invention to provide a gas fireplace insert wherein the installed insert creates the illusion of a single appliance set in an open hearth while still providing effective heating and circulation of room air.

It is a further object of the invention to provide a fireplace insert for a wood burning fireplace that is easier to install than prior art inserts, and which is easier to connect the insert vent to flue liners or ducting.

It is yet a further object of the invention to provide airflow around the fireplace insert that minimizes obstructive turbulence near the top of the insert.

These and other objects of the invention will be more fully appreciated by reference to the detailed description that follows. It will be noted that not all objects of the invention are necessarily realized in all possible embodiments of the invention as defined by each claim.

SUMMARY OF THE INVENTION

The invention consists of a gas fireplace insert assembly for insertion into a fireplace comprising a hearth with a floor, a mouth and a lintel. The insert assembly comprises a firebox having a base, a top, rear and side walls, and an outer shroud defining an heat exchange passageway surrounding the firebox for conveying air around the firebox and back into the room.

According to one aspect of the invention, the insert assembly comprises an air guide plate extending forward of the top of the passageway outlet. In a more particular aspect, the guide plate is adjustably securable to extend at various distances and angles from the top of the passageway outlet, thereby allowing the pathway outlet to be above the top edge of the fireplace mouth. This in turn allows the top edge of the insert window to be less visible from outside the fireplace.

In another aspect the guide plate comprises spaced threaded stubs, the spacing of which corresponds to spacing between slots formed in tabs extending forward of the top of the insert, said stubs being adapted to be seated in said slots.

According to another aspect of the invention, the insert comprises removable legs adapted to be removably secured to the bottom surface of the firebox. These allow the insert to be installed and then raised off the floor in the fireplace hearth such that the passageway outlet may be higher than the bottom edge of the lintel or smoke curtain, before securing the legs to the insert.

In another aspect, the top of the rear wall of the firebox is coloured a dark colour such as black while the balance of the rear wall has a lighter, contrasting colouring whereby to simulate the appearance of an open firelog basket.

In yet a further aspect, the invention comprises a gas fireplace insert and a decorative fender for installation in front of said insert, and wherein the fender is seated in front of the insert and rearwardly of the plane of the fireplace mouth.

In yet a further aspect, the invention comprises a fireplace comprising a fireplace hearth with a floor, a gas fireplace insert seated on said hearth floor, at least one vent extending from the firebox of the insert to the exterior of the fireplace and wherein the space between the gas fireplace insert and the interior walls of the hearth function as a passageway for drawing in room air, circulating said room air around the gas fireplace insert and expelling said room air back into the room.

In yet a further aspect, the fireplace according to the invention includes a gas fireplace insert that has a front window with a transparent panel therein, said panel being in a plane that is spaced rearwardly from the plane of the mouth of the fireplace, the panel extending upwards at least to within 2 inches of the lintel.

In a further aspect of the fireplace according to the invention, the fireplace hearth has a rear wall that is painted black, and portions of said rear wall are visible from the front of the fireplace.

In yet a further aspect, the invention comprises a fireplace including an insert with removable legs on the base thereof, means for connecting a guide plate to the top of the insert, a guide plate extending from the top of the insert forward to the front of the top edge of the fireplace mouth, the insert being seated into the fireplace such that the window of the insert lies in a plane that is rearwardly offset in relation to the plane of the fireplace mouth, and a fender seated on the fireplace hearth and set back into the fireplace. The top edge of the insert window is located within 2 inches of the top edge of the fireplace mouth. The top portion of the rear wall of the insert firebox is coloured a darker colour such as black and room air has substantially unimpeded access to the sides of the insert.

In another aspect the invention comprises a method of installing a fireplace insert comprising the steps of removing removable legs from the base of the insert, sliding the insert into the hearth such that the plane of the insert window is spaced rearwardly from the plane of the fireplace mouth, connecting liners to the insert, raising the insert into the fireplace and re-installing the legs, and installing a guide plate between the top of the insert and the top of the fireplace mouth. In a further aspect, a fender is also disposed on the hearth floor in front of the insert and rearwardly of the plane of the fireplace mouth.

In another aspect, the invention comprises a gas fireplace insert assembly, comprising a firebox having a base and legs adapted to be removably secured to said base.

In a further aspect, the firebox comprises a top and at least one wall, the wall extends between the top and the base such that the base, the top and the at least one wall define a front-opening firebox; the wall has a rear portion and side portions having a dark colour and a contrasting light colour, the light colour extends downward from a demarcation between the dark and light colours to the base; and the demarcation is continuous across the rear and side portions. In yet a further aspect, the at least one wall comprises a rear wall and opposed side walls.

In a further aspect, the top and base each have inner surfaces facing the interior of the firebox and outer surfaces, and the dark colour is applied to the inner surfaces, to the outer surfaces, to the legs and to an outer surface of the wall.

In another aspect, the invention comprises a gas fireplace insert assembly with a decorative fender having a width of at least the distance between the opposed side walls of the assembly.

In further aspect, the invention comprises a gas fireplace insert assembly with a heat exchange passageway for conducting air from the vicinity of the base and along at least one outer wall of the firebox, and having an outlet defined between the top and a top panel mounted in spaced relationship to the top; a guide plate for guiding in a forward direction air exiting the outlet, where the guide plate is removably attached to said top panel; and a decorative fender having a width of at least the distance between opposed side walls of the assembly.

In a further aspect, the top panel comprises one or more forwardly extending tabs and the guide plate is adapted to be removably attached to said tabs. In yet a further aspect, the guide plate comprises one or more downwardly extending stubs, each of which is adapted to be removably attached to one of the forwardly extending tabs; and each of the one or more downwardly extending stubs may be spaced from a longitudinal centreline of the guide plate.

In another aspect, the invention comprises a gas fireplace insert assembly comprising a firebox having a base, opposed side walls and a top; legs adapted to be removably attached to the firebox base; a heat exchange passageway for conducting air from the vicinity of the base and along at least one outer wall of the firebox, and having an outlet defined between the top and a top panel mounted in spaced relationship to the top; and a guide plate for guiding in a forward direction air exiting the outlet, the guide plate being removably attached to the top panel.

In another aspect, the invention comprises a gas fireplace insert assembly comprising a firebox having a base, opposed side walls and a top; a heat exchange passageway for conducting air from the vicinity of the base and along at least one outer wall of the firebox, and having an outlet defined between the top and a top panel mounted in spaced relationship to the top; and a guide plate for guiding in a forward direction air exiting the outlet, the guide plate being removably attached to said top panel. In a further aspect, the gas fireplace insert assembly may comprise legs adapted to be removably attached to the firebox base.

In another aspect, the invention comprises a fireplace comprising a hearth having a floor, a mouth and a lintel and further comprising a gas fireplace insert assembly resting on the floor, where the insert assembly comprises a base, a top and at least one wall extending between the base and the top and legs adapted to be removably secured to said base; where the top extends above the height of the lintel.

In a further aspect, the invention comprises a fireplace with a heat exchange passageway for conducting air from the vicinity of the base and along at least one outer wall of the firebox, and having an outlet defined between the top and a top panel mounted in spaced relationship to the top and a guide plate for guiding in a forward direction air exiting the outlet, the guide plate being removably attached to said top panel.

In yet a further aspect, the invention comprises a fireplace with at least two contrasting colours inside the insert assembly; and a dark colour applied to the inside of the hearth. The contrasting colours may comprise a dark colour and a light colour. In yet a further aspect, the wall of the insert assembly may have a rear portion and side portions having a dark colour and a contrasting light colour, the light colour extending downward from a demarcation between the dark and light colours to the base; and the demarcation being continuous across said rear and said side portions. In yet a further aspect, the dark colour may be further applied to the legs and to all outer surfaces of the insert assembly.

In a further aspect, the fireplace may comprise a decorative fender inside the hearth, between the insert assembly and the mouth. The decorative fender may be unsupported by the insert assembly.

In another aspect, the invention comprises a method of installing a gas fireplace insert assembly in a fireplace having a rear wall, a hearth having a floor, a mouth and one or more ducts, comprising the steps of placing a gas fireplace insert onto the floor through the front opening; connecting the insert to the one or more ducts; and attaching one or more supports to an underside of the insert, thereby lifting the insert away from the floor.

In a further aspect, the method of the invention may comprise installing a gas fireplace insert assembly, wherein the insert further comprises a firebox having a base, a top and a heat exchange passageway for conducting air from the vicinity of the base and along at least one outer wall of the firebox, the heat exchange passageway having an outlet defined between the top and a top panel mounted in spaced relationship to the top, and the method may further comprise the step of attaching to the top panel a guide plate for guiding in a forward direction air exiting the outlet, the guide plate being removably attachable to the top panel.

In yet a further aspect, the method of the invention further comprises the step of placing a decorative fender on the floor of the fireplace between the insert and the mouth.

Other aspects of the invention will be appreciated by reference to the detailed description of the preferred embodiment and to the claims.

BRIEF DESCRIPTION OF THE DRAWINGS

The preferred embodiment of the invention will be described by reference to the attached drawings in which.

DETAILED DESCRIPTION OF THE PREFERRED EMBODIMENT

Figure 1:
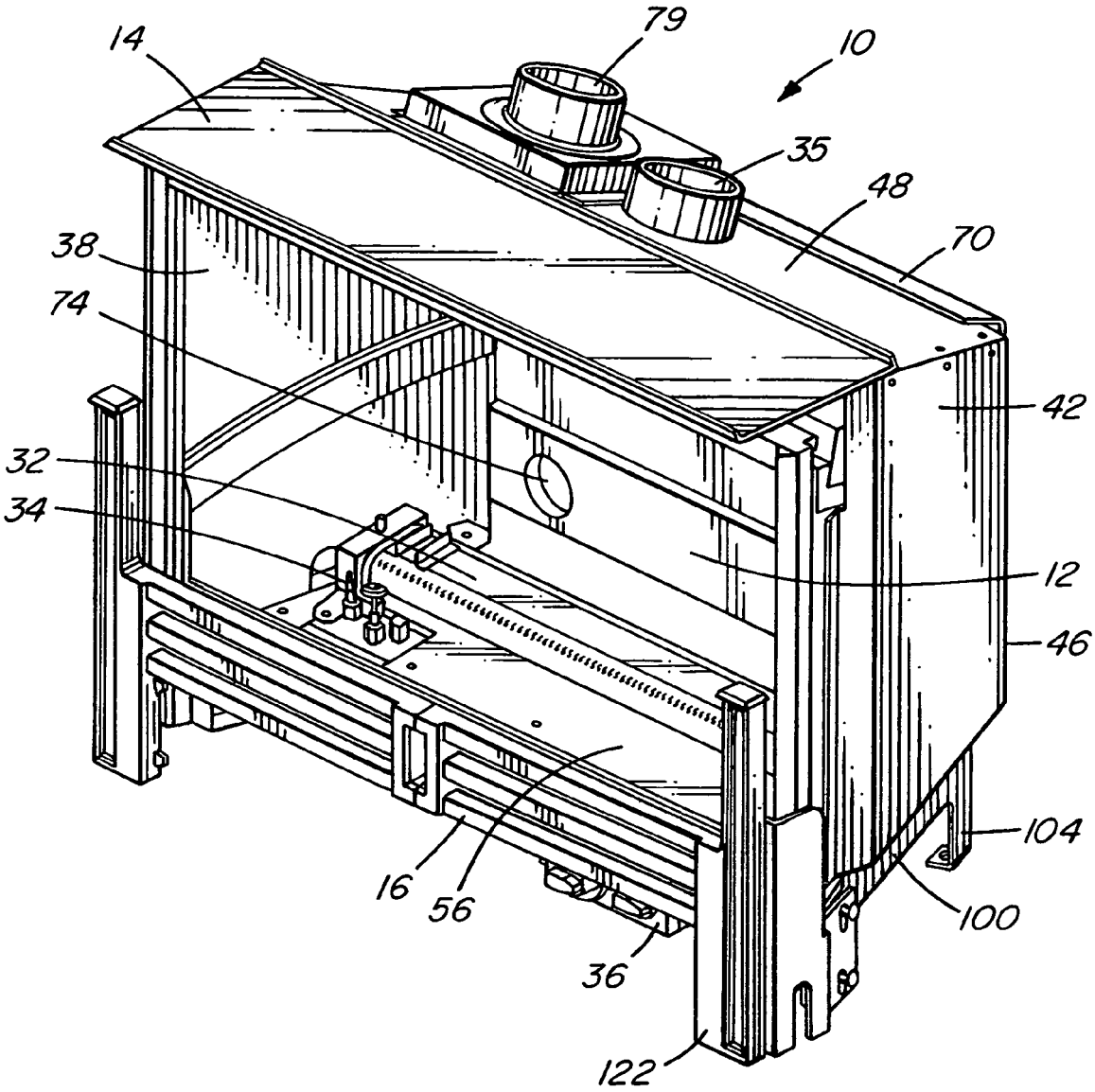
FIG. 1 is a perspective view of an embodiment of the insert assembly according to the preferred embodiment of the invention.

Referring to FIG. 1, the insert assembly 10 according to the preferred embodiment generally comprises an insert 12, a heated air exhaust guide plate 14 and a decorative fender 16.

Figure 13:
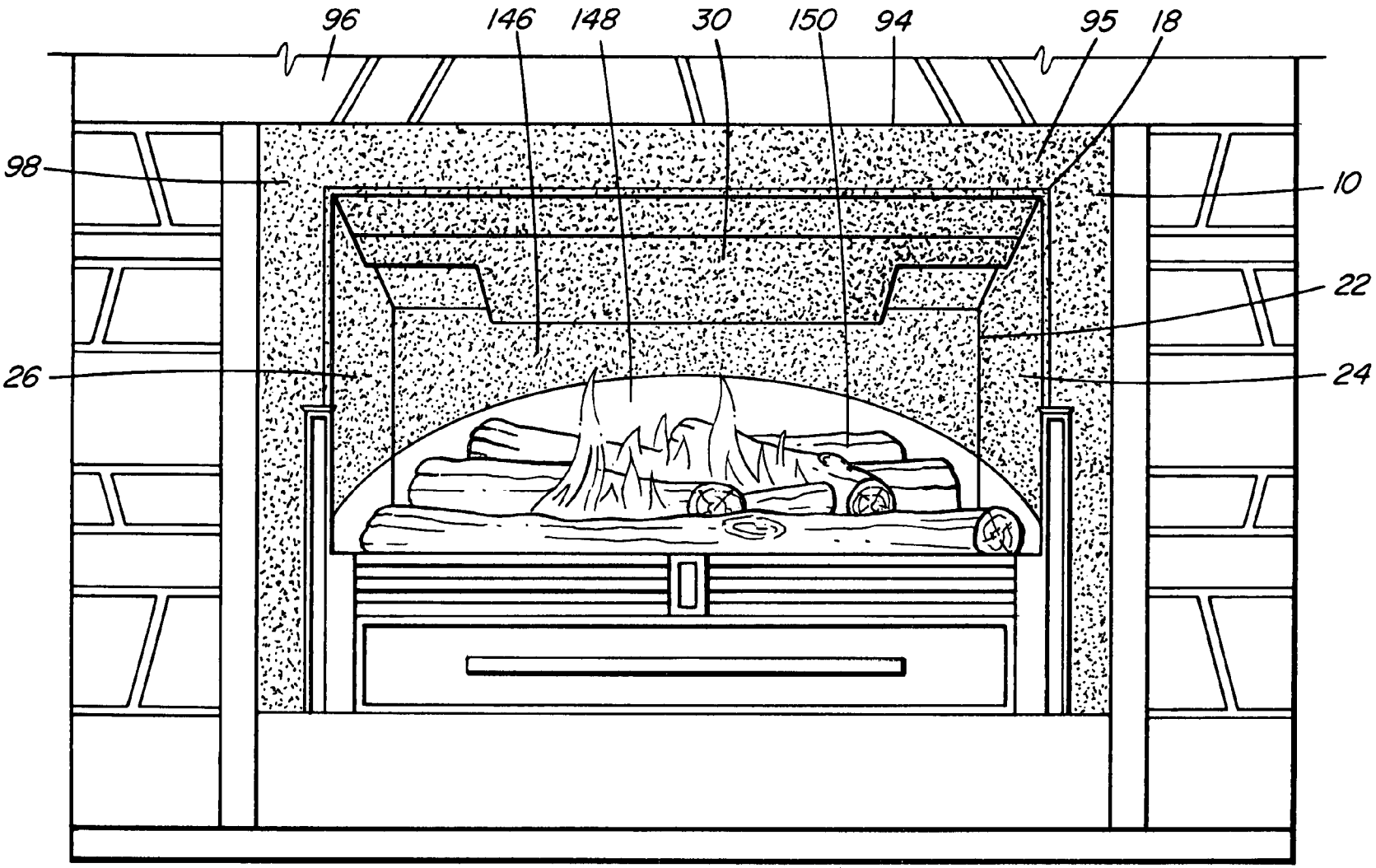
FIG. 13 is a front view of an embodiment of the insert assembly, in place in a typical fireplace hearth.

Insert 12 includes a firebox, a burner assembly, a shroud partially surrounding the firebox and a heat exchange passageway, as described below. A log set 150 (seen only in FIG. 13), for example ceramic simulated logs, may be placed within insert 12 to enhance the resemblance of insert assembly 10 to an actual wood-burning fireplace.

Figure 2:
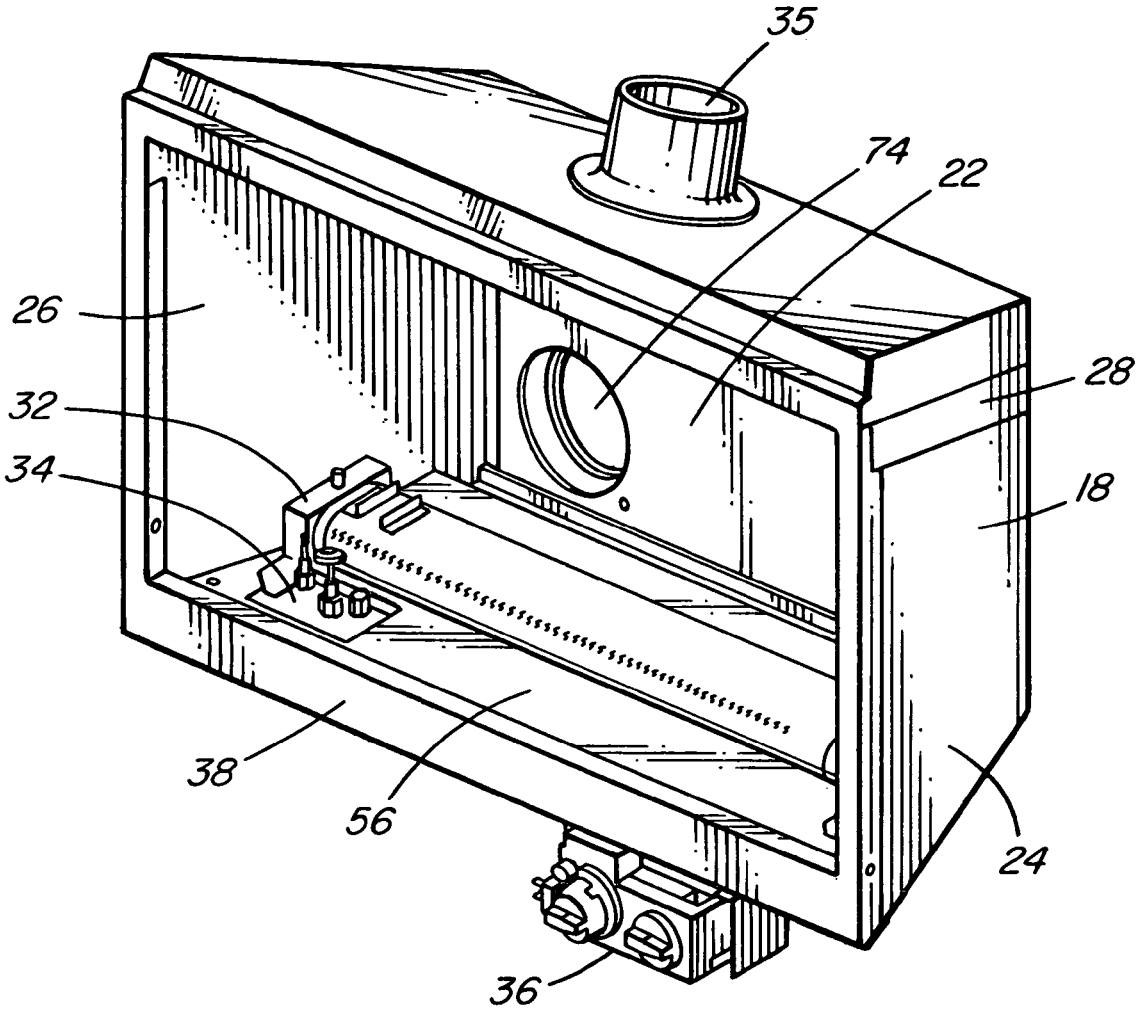
FIG. 2 is a front view of an embodiment of an insert according to the invention, excluding the heat exchange shroud.
Figure 3:
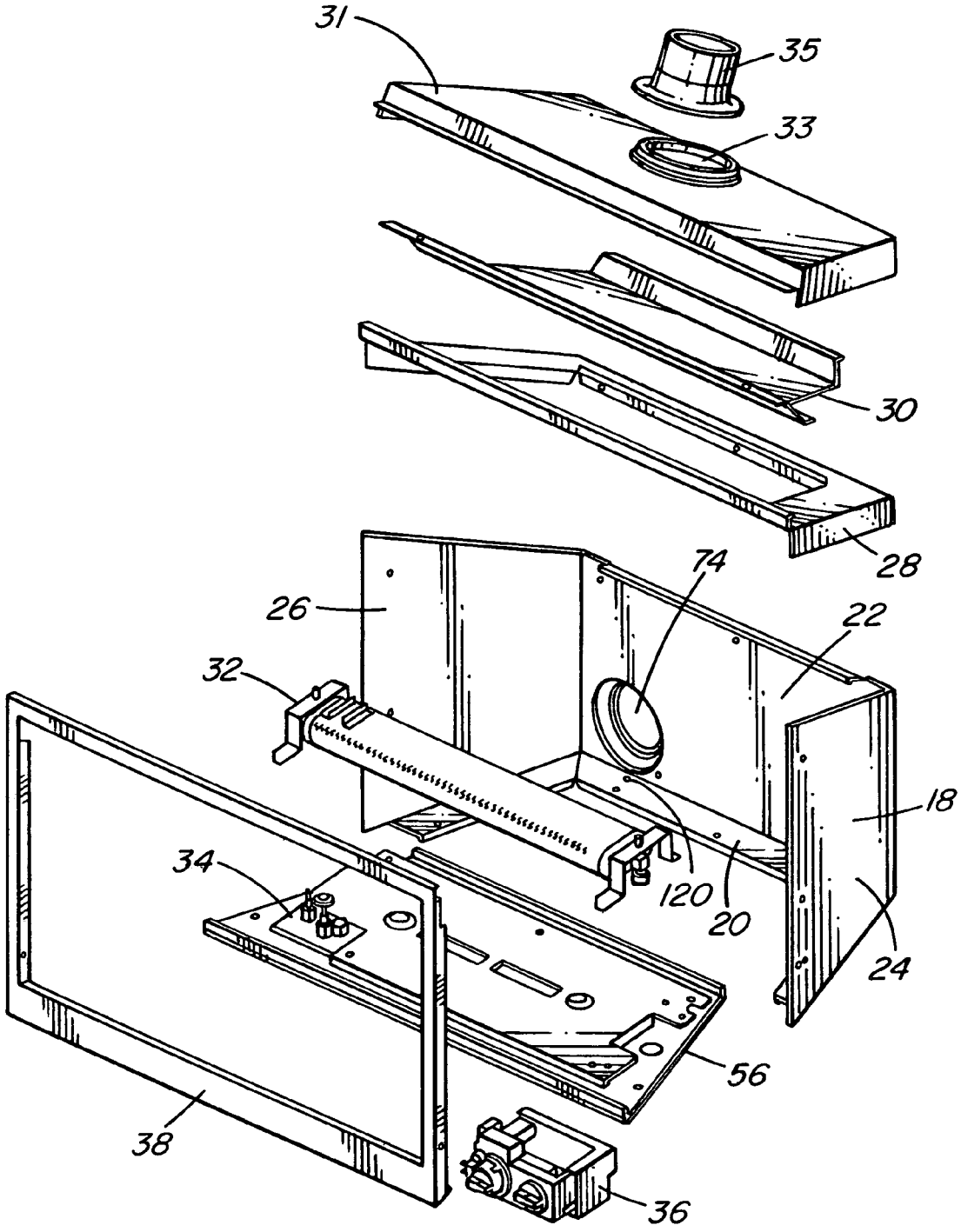
FIG. 3 is an exploded perspective view of the insert of FIG. 2.

Referring to FIGS. 2 and 3, a front-opening firebox 18 is defined by a base 20 (which may be a full base or a base rim 20, as in the illustrated embodiment), a rear wall 22, at least one side wall (two opposed side walls 24, 26 are shown in the embodiment illustrated in FIGS. 2 and 3) and a firebox top 28. A baffle 30 controls the flow of combustion exhaust gases. Firebox cover 31 includes an aperture 33 to which is attached an exhaust collar 35.

A burner assembly is seated on base rim 20 and includes a burner plate 56, a burner 32, a pilot assembly 34 and a control and fittings assembly 36. A window and glass panel 38 are fitted to the front of the insert 12.

Figure 4:
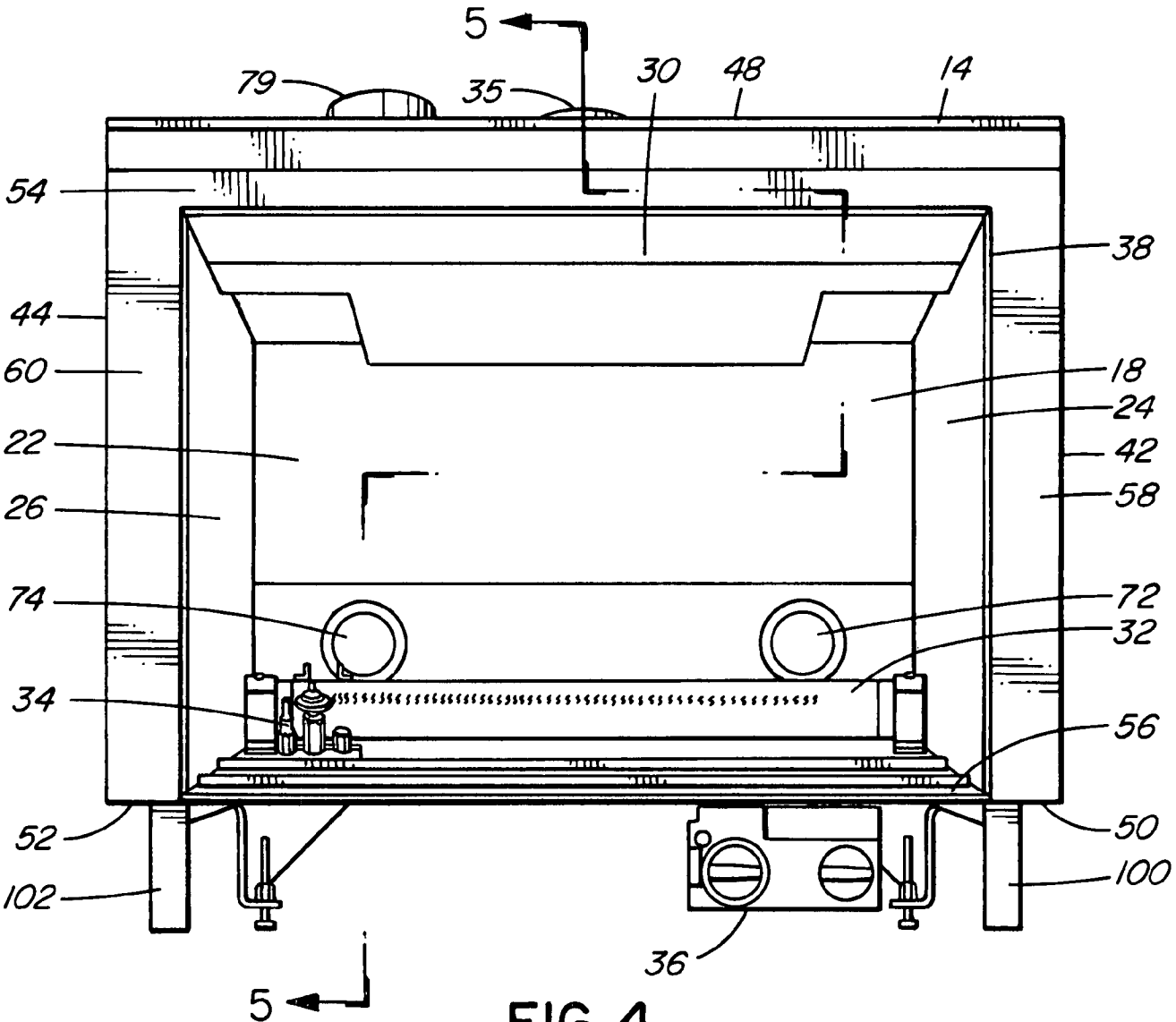
FIG. 4 is a front view of an embodiment of the insert and shroud.
Figure 5:
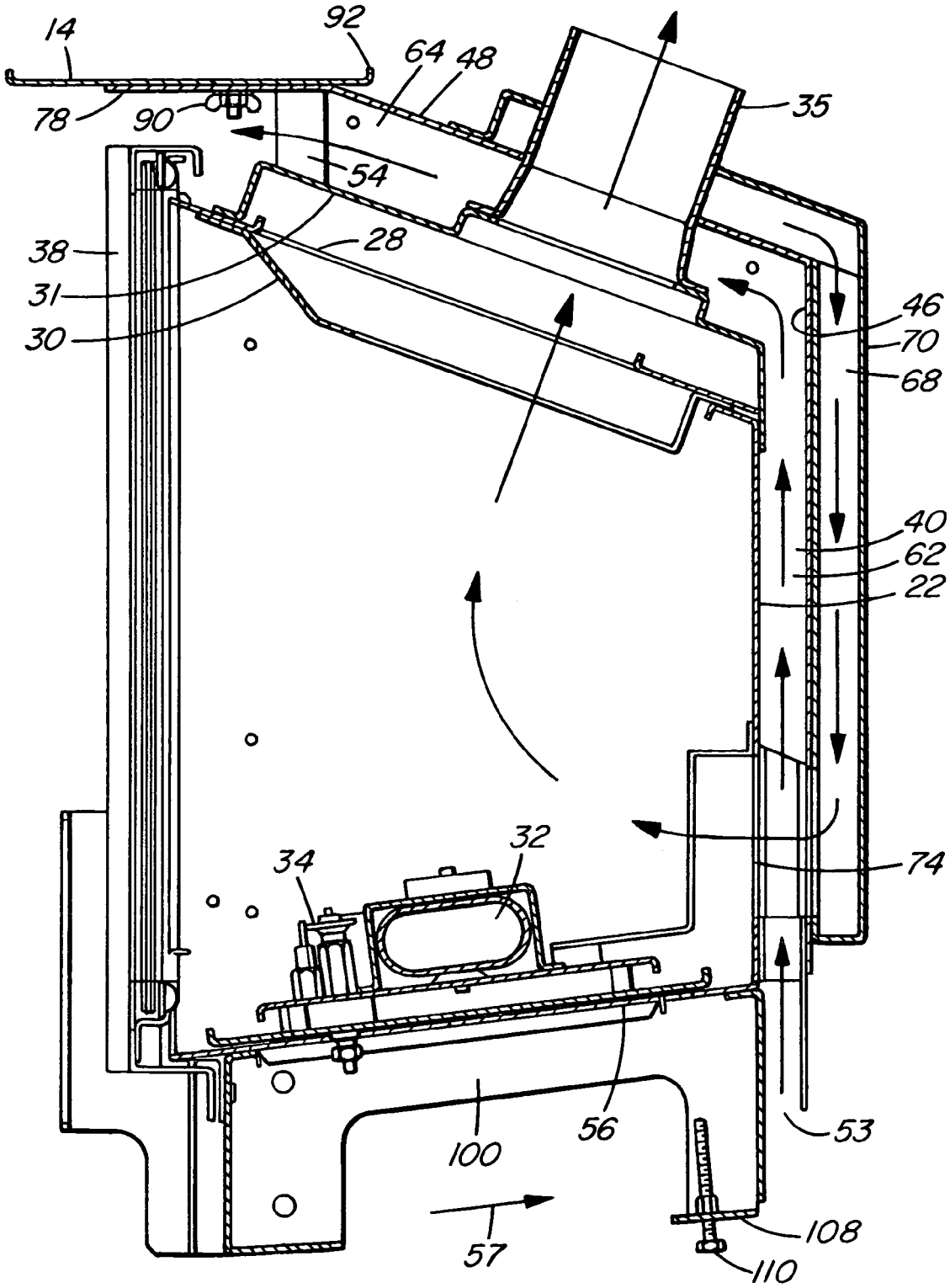
FIG. 5 is a sectional view along line 5-5 of FIG. 4, and further including the heated air exhaust guide plate.

Referring to FIGS. 4 and 5, a heat exchange passageway 40 is defined by a shroud comprising side shroud panels 42, 44 (seen only in FIG. 4), rear shroud panel 46 and top shroud panel 48, each of which is spaced from the adjacent walls of the firebox 18 to define the passageway 40. Gaps 50, 52 at the bottom edges of the side shroud panels 42, 44 and gap 53 at the bottom edge of rear shroud panel 46 form room air inlets for the passageway 40.

A gap 54 at the forward edge of the top shroud panel 48 defines the passageway outlet. In use, room air is drawn under the burner plate 56 as indicated by arrow 57, through the gaps 50, 52 and 53, up the sides 58, 60 and rear 62 portions of the passageway 40 and across the top 64 of the passageway 40. The heated air is exhausted out of the outlet 54 between the top shroud panel 48 and the firebox cover 31. A blower (not shown) may optionally be seated beneath the firebox to draw room air under the base and into the heat exchange passageway. In the absence of a blower, natural convection will draw sufficient room air into the passageway 40.

Figure 8:
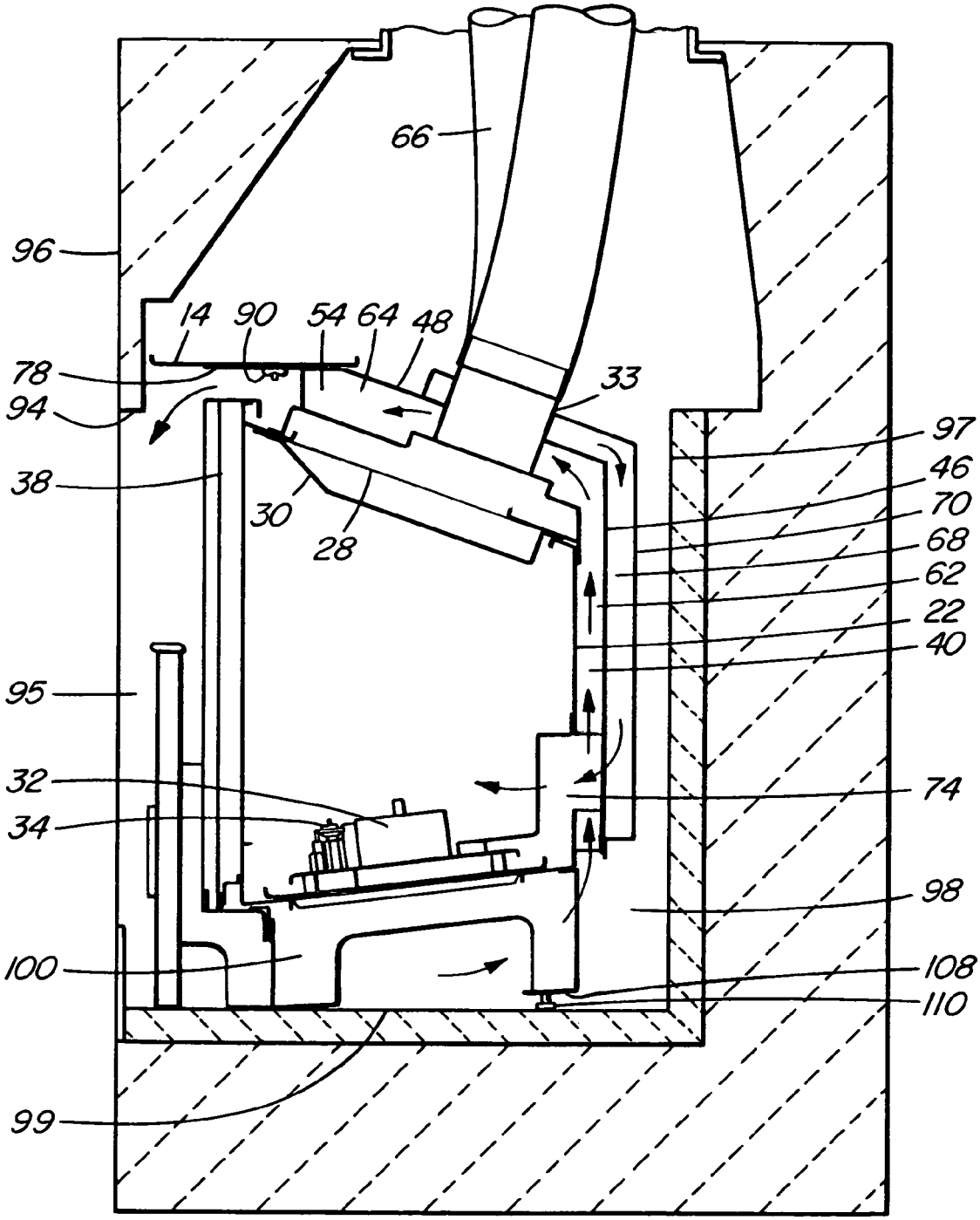
FIG. 8 is a sectional view along line 8-8 of FIG. 7, including a fender.

Referring now to FIGS. 5 and 8, combustion air is drawn through a vent liner 66, partially visible in FIG. 8. Vent liner 66 is attached to combustion air inlet collar 79 (see FIG. 9) and into a combustion air duct 68 defined between wall 70, top shroud panel 48 and rear shroud panel 46. FIGS. 1-5 illustrate a pair of short inlet pipes 72, 74 that extend from combustion air duct 68, through heat exchange duct 40, and that open into the bottom of the firebox 18. Only inlet 74 is visible in the views provided by FIGS. 1-3.

Figure 9:
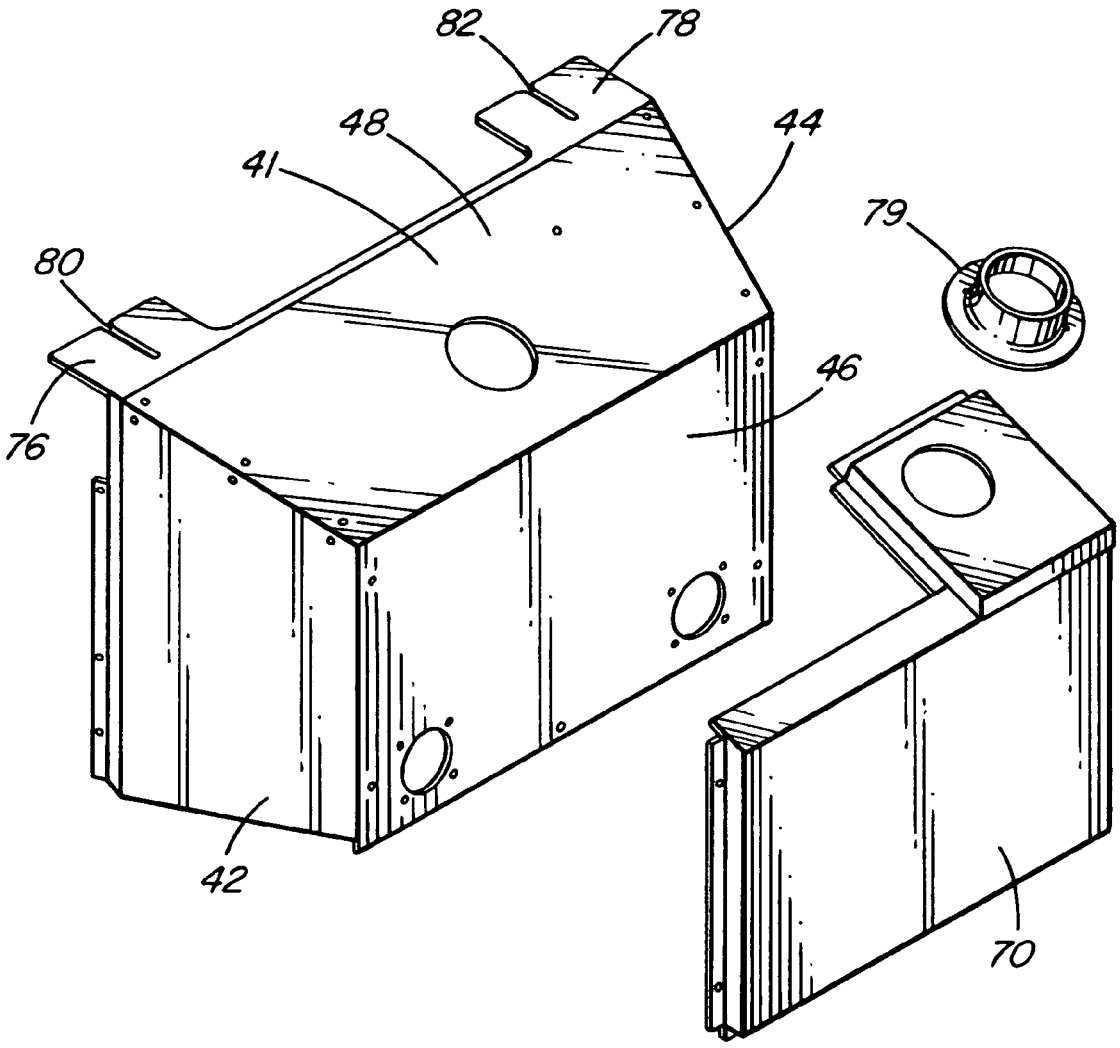
FIG. 9 is a rear view of the firebox and heat exchange shroud of an embodiment of the insert assembly, with the air inlet collar exploded therefrom.

As best seen in FIG. 9, the forward edge of the top shroud panel 48 is provided with opposed, forwardly extending tabs 76, 78 each comprising an elongated slot 80, 82 for securing heated air exhaust guide plate 14 to the top shroud panel 48.

Figure 10:
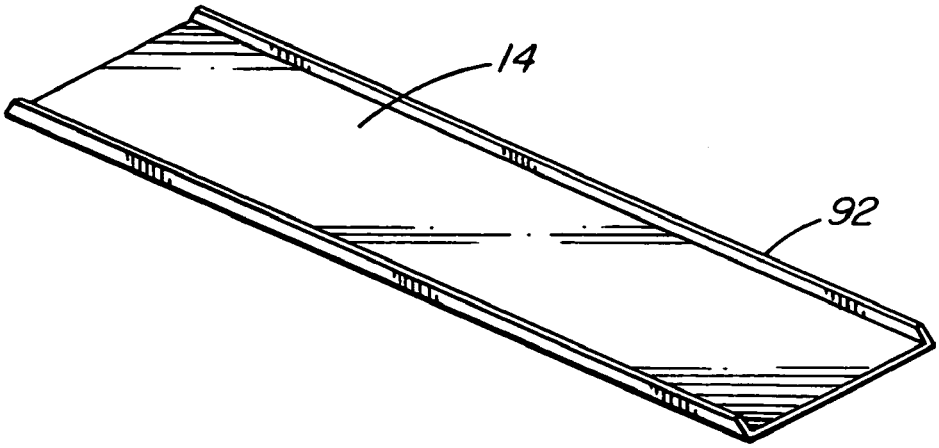
FIG. 10 is a perspective view of the heated air exhaust guide plate.
Figure 11:
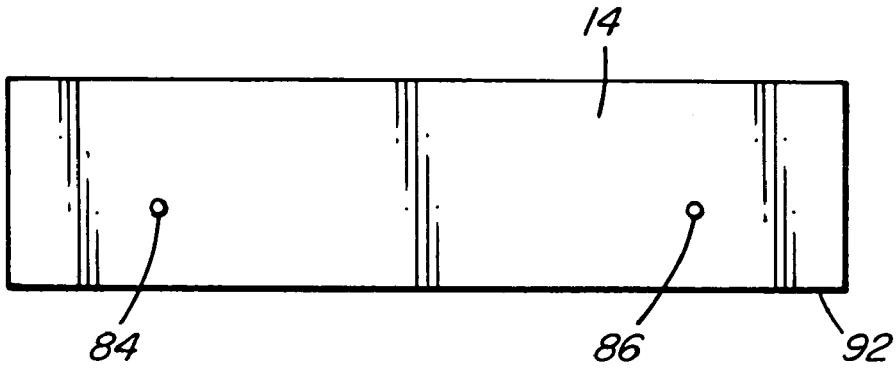
FIG. 11 is a bottom view of the heated air exhaust guide plate.

Guide plate 14 is illustrated in FIGS. 10 and 11. It comprises an elongated generally rectangular panel having a length approximately corresponding to the lateral extent of the insert. The width of the panel may be chosen to suit the fireplace in which the insert will be installed. For a typical 36" wide by 17" high by 14" deep fireplace, the width of the preferred panel according to the invention is 5". The underside of the guide plate 14 is provided with two threaded stubs 84, 86 sized for engagement into slots 80, 82 of the tabs 76, 78.

Figure 12:
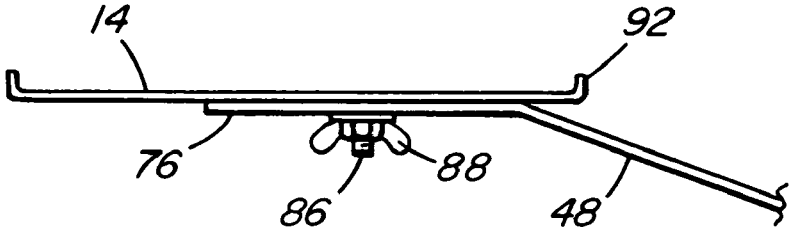
FIG. 12 is a side view of the connection between the heated air exhaust guide plate and the top shroud panel of the insert.

As best illustrated in FIG. 12, guide plate 14 may be secured to tabs 76, 78 of top shroud panel 48 by engaging stubs 84, 86 into slots 80, 82 and tightening wing nuts 88, 90 onto the stubs. Stubs 84, 86 are spaced from the rear edge 92 of the guide plate 14 a distance greater than the distance between the forward end of the slots 80, 82 and the forward edge of the top shroud panel 48. Doing so ensures that when the stubs 84, 86 are engaged at the forwardmost end of the slots 80, 82, the rear edge 92 of the guide plate will still extend rearwardly of the forward edge of top shroud panel 48. Provided the stubs 84, 86 are spaced from the longitudinal centreline of the guide plate 14, the guide plate 14 can be turned around to achieve a different maximum forward reach.

Referring to FIG. 8, guide plate 14 acts to direct heated room air that is exhausted from the duct outlet 54. This allows the top of the duct outlet 54 to be above the top edge 94 (which may be the bottom edge of a smoke curtain or lintel 96) of the fireplace mouth 95. As a result, the insert may be seated higher off the floor 99 of the fireplace hearth than is the case for prior art inserts, thereby allowing the top edge of the glass panel 38 to be completely or nearly hidden from view. This helps to camouflage the top part of the insert and enhances the illusion of a simple burner seated in an original fireplace.

Figure 6:
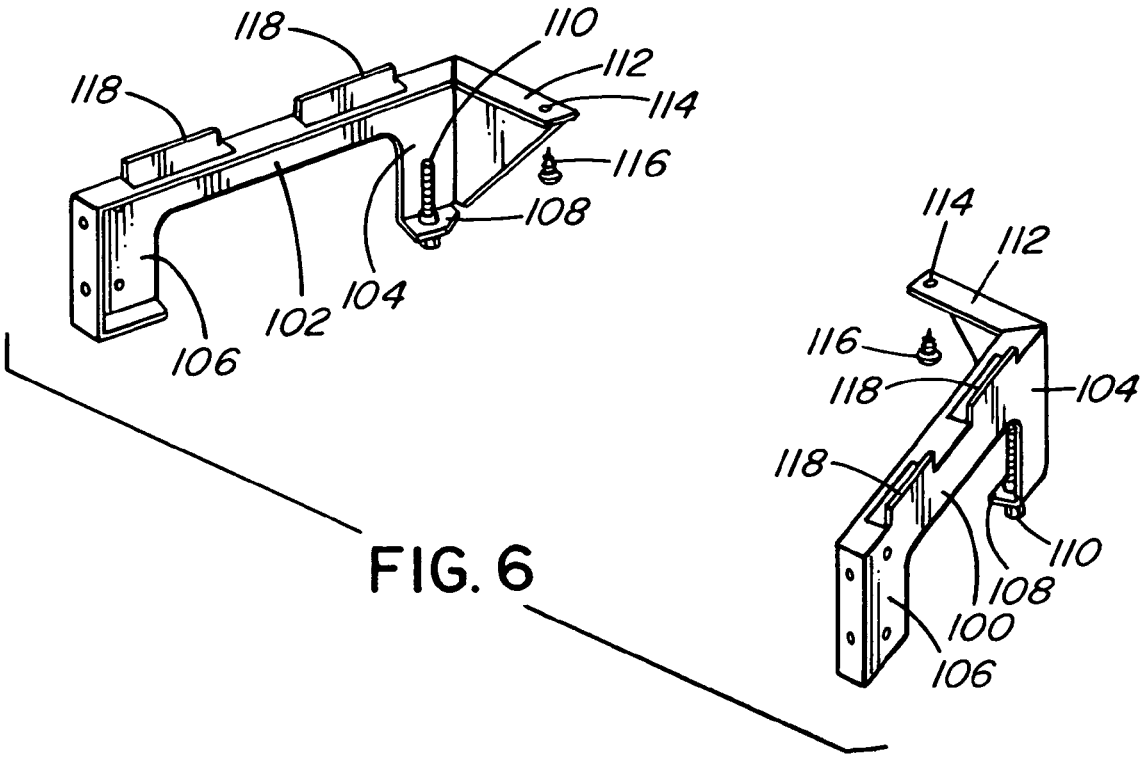
FIG. 6 is a perspective view of the removable legs of an embodiment of the insert assembly.

As best shown in FIG. 6, a pair of removable supports, such as legs 100, 102 are each provided with spaced posts 104, 106. One of posts 104 has a horizontal flange 108 through which a leveling bolt 110 is threaded. Each support 100, 102 also includes an upper flange 112 provided with a bore 114 adapted to receive a screw 116, and two upstanding walls 118 to assist in locating the support in relation to the base rim 20 of the insert 12. Legs 100, 102 are preferably shaped to correspond to the shape of base rim 20 on respective sides of the insert 12. Rim 20 is provided with bores 120 to correspond with each of bores 114 for releasably securing legs 100, 102 to the rim 20 during installation of the insert 12.

A decorative fender 16 is provided with suitable means 122 allowing the fender 16 to be positioned as a freestanding unit on the floor 99 of the fireplace hearth 98 in front of the insert 12. Fender 16 is preferably made to resemble a protective fender used in an open hearth fireplace. Fender 16 generally has a width of at least the distance between the opposed side walls 24, 26.

Figure 7:
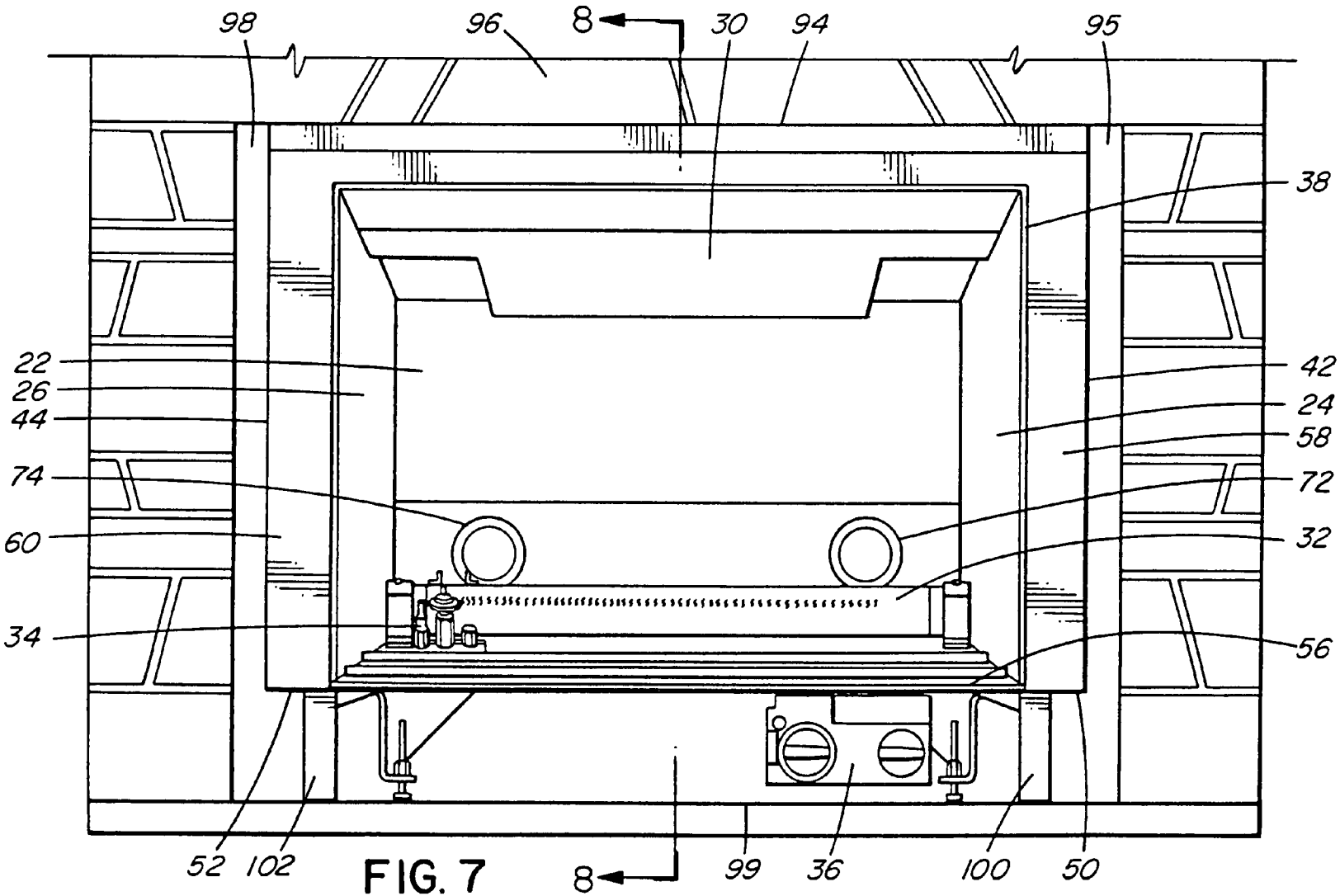
FIG. 7 is a front view of an embodiment of the insert assembly, in place in a typical fireplace hearth, without a fender.

The installation of the fireplace insert assembly according to the invention will now be described with references to FIGS. 7 and 8. The insert assembly is generally installed in an existing fireplace having a rear wall 97, a hearth 98 with a floor 99, a front mouth 95, and one or more ducts or liners 66 and/or 68, normally including at least an exhaust liner and for sealed combustion systems, a combustion air liner.

Prior to seating the insert assembly 10 into the fireplace hearth 98, legs 100, 102 are removed from the insert assembly 10. The insert assembly 10 is then slid rearwardly through fireplace mouth 95, along the hearth floor 99 and as far back as possible into the hearth 98. It is no longer necessary to align the front panel of the insert assembly 10 with the mouth 95, as is required in the prior art.

With the legs 100, 102 removed and the insert assembly 10 seated and set back on the floor 99 of the hearth 98, there is sufficient space above the insert assembly 10 to enable the installer to connect the exhaust and combustion air liners 66, 68 to the collars 35 and 79 respectively, without the need for sophisticated vent engagement systems. The clearance provided by the insert assembly 10 and the position of the insert assembly 10 in the fireplace make access to the liners and their connection to the insert assembly 10 considerably easier than in the prior art.

Once the liners are connected to the insert assembly 10, the insert assembly 10 is then raised off the floor 99 of the hearth 98 and legs 100, 102 are re-installed on the base of the insert assembly 10 using appropriate fasteners.

The guide plate 14 is installed by first loosely engaging wing nuts 88, 90 onto stubs 84, 86. The guide plate 14 is then angled past the top edge 94 of the fireplace mouth 95 and stubs 84, 86 are engaged into slots 80, 82 of tabs 76, 78 such that tabs 76, 78 are sandwiched between the wing nuts 88, 90 and the guide plate 14. The guide plate 14 is then extended forward to contact, or nearly contact, the front of the fireplace and the wing nuts 88, 90 are tightened.

The guide plate 14 ensures that air exhausted from the heat exchange passageway outlet 54 will be directed to the fireplace mouth 95 with minimal turbulence being generated atop the insert 10. This arrangement promotes the smooth flow of air back into the room resulting in increased efficiency.

Fender 16 is then installed in front of the insert assembly 10, but is placed as far back into the hearth 98 as possible. The ability to set back the fender 16 on the floor 99 of the hearth 98 is the result of the ability to set back the insert assembly 10 itself into the fireplace mouth 95. This in turn is the result of using the guide plate 14, which overcomes the turbulence effects that would otherwise be suffered from seating the insert assembly 10 too far back into the fireplace mouth 95.

No additional facing or trim is required around the edges of the insert assembly 10 or of the fireplace mouth 95. The absence of trim and the setting back of the insert assembly 10 and fender 16 into the fireplace hearth 98 enhances the effect of a stand-alone grate and log set 150 seated in a fireplace enclosure.

Colouring the upper portion 146 of at least one of the firebox side walls 24, 26, rear wall 22 and baffle 30 a darker colour, such as black, while providing a contrasting lighter coloured lower portion 148 surrounding the log set 150 can further enhance such effect. In an embodiment best shown in FIG. 13, the lighter coloured portion 148 wraps around the lower portions of side walls 24 and 26 in an arc descending from back to front, the arc continuing across rear wall 22. The contrast provided by the demarcation between the light and dark areas distracts the viewer from the joints and edges of the side and rear walls and enhances the illusion that the fireplace insert 10 spans the entire width of the fireplace, rather than being confined to the area within the firebox 18. This produces the same visual effect as would be expected in a wood-burning fireplace where soot, ash and other residue rise up from the burning logs towards a chimney, but partially deposit on the rear wall of the fireplace. This also camouflages the edges of the insert assembly 10, allowing the edges to blend into the shadows of the hearth 98. The insert assembly 10 in place thus appears identical to a wood-burning fireplace and appears to completely occupy the space inside the fireplace hearth 98, without excess trim or other components around the outer edges of insert assembly 10.

The inner surfaces of the hearth 98 may also be coloured a dark colour, similar to the dark colour on the insert assembly 10, further camouflaging the edges of the insert assembly 10 and providing the illusion of a larger, deeper hearth 98.

In another embodiment, more parts of the insert assembly 10, except the lighter coloured portion 148, may also be a dark colour. This may include the outer surfaces of the base rim 20, rear wall 22, side walls 24, 26, firebox top 28 and legs 100, 102, to ensure no outer part of the insert assembly 10 is visible in the darkness of the hearth 98

The insert assembly 10 according to the invention may include a window that is larger than the prior art inserts and whose top edge is hidden behind the top edge of the fireplace mouth 95, further masking the frame of the insert 10.

As the invention obviates the need for trim between the insert assembly 10 and the fireplace mouth edges, a freer flow of room air around the insert is made possible. Despite seating the insert assembly 10 as far back as possible within the fireplace hearth, there will typically be space for room air to be drawn in around the sides of the insert, in addition to any room air entrained into the heat exchange passageway. Such air will be drawn principally by convection but some of the air may be incidentally entrained towards the sides of the insert as a result of the operation of a blower which otherwise seeks to entrain air into the heat exchange passageway. The air then proceeds by convection up the sides and back of the insert and will find its way around guide plate 14. As a result, the room air will undergo secondary heat exchange from contact with the exterior walls and panels of the insert, thereby further heating the room.

The invention therefore achieves the objects of an insert having a significantly improved visual appearance when seated in a fireplace. The insert is also easy to install and provides an efficient heat exchange with the room air.

It will be appreciated that while the preferred embodiment of the invention has been described, other variations may be practised within the scope thereof without departing from the principles of the invention.

The invention claimed is:

1. A gas fireplace insert assembly, comprising:

a firebox having a base a top and at least one wall, said at least one wall extending between said top and said base such that said base, said top and said at least one wall define a front-opening firebox;

legs adapted to be removably secured to said base;

said at least one wall has a rear portion and side portions having a dark color and a contrasting light color, said light color extending downward from a demarcation between said dark and said light colors to said base; and said demarcation being continuous across said rear and said side portions.

2. The gas fireplace insert assembly of claim 1 wherein said at least one wall comprises a rear wall and opposed side walls.

3. The gas fireplace insert assembly according to claim 1 or 2 wherein said dark color is applied to said top and said base.

4. The gas fireplace insert assembly of claim 1 wherein said top and said base each have inner surfaces facing the interior of said firebox and outer surfaces, and said dark color is applied to said inner surfaces, to said outer surfaces, to said legs and to an outer surface of said at least one wall.

5. The gas fireplace insert assembly of claim 2 or claim 4 further comprising a decorative fender having a width of at least the distance between said opposed side walls.

6. The gas fireplace insert assembly of claim 2 wherein:

said top and said base each have inner surfaces facing the interior of said firebox and said dark color is applied to said inner surfaces;

said top and said base each have outer surfaces, and said dark color is applied to said outer surfaces, to said legs and to an outer surface of said at least one wall;

and further comprising:

a heat exchange passageway for conducting air from the vicinity of said base and along at least one outer wall of said firebox, and having an outlet defined between said top and a top panel mounted in spaced relationship to said top;

a guide plate for guiding in a forward direction air exiting said outlet, said guide plate being removably attached to said top panel; and a decorative fender having a width of at least the distance between said opposed side walls.

7. The gas fireplace insert assembly of claim 6, wherein said top panel comprises one or more forwardly extending tabs and said guide plate is adapted to be removably attached to said tabs.

8. The gas fireplace insert assembly of claim 7 wherein:

said guide plate comprises one or more downwardly extending stubs, each of which is adapted to be removably attached to one of said forwardly extending tabs; and each of said one or more downwardly extending stubs is spaced from a longitudinal centreline of said guide plate.

9. A gas fireplace insert assembly comprising:

a firebox having a base, opposed side walls and a top;

legs adapted to be removably attached to said firebox base;

a heat exchange passageway for conducting air from the vicinity of said base and along at least one outer wall of said firebox, and having an outlet defined between said top and a top panel mounted in spaced relationship to said top; and a guide plate for guiding in a forward direction air exiting said outlet, said guide plate being removably attached to said top panel.

10. The gas fireplace insert assembly of claim 9 further comprising a decorative fender having a width of at least the distance between said opposed side walls.

11. The gas fireplace insert assembly of claim 10, wherein:

said top panel comprises one or more forwardly extending tabs; and said guide plate is adapted to be removably attached to said forwardly extending tabs.

12. The gas fireplace insert assembly of claim 11 wherein:

said guide plate comprises one or more downwardly extending stubs, each of which is adapted to be removably attached to one of said forwardly extending tabs; and each of said one or more downwardly extending stubs is spaced from a longitudinal centreline of said guide plate.

13. A gas fireplace insert assembly comprising:

a firebox having a base, opposed side walls and a top;

a heat exchange passageway for conducting air from the vicinity of said base and along at least one outer wall of said firebox, and having an outlet defined between said top and a top panel mounted in spaced relationship to said top; and a guide plate for guiding in a forward direction air exiting said outlet, said guide plate being removably attached to said top panel.

14. The gas fireplace insert assembly of claim 13 further comprising legs adapted to be removably attached to said firebox base.

15. A fireplace comprising a hearth having a floor, a mouth and a lintel and further comprising:

a gas fireplace insert assembly resting on said floor, said insert assembly comprising:

a base, a top frame member extending substantially from side to side of the insert and at least one wall extending between said base and said top; and legs adapted to be removably secured to said base;

said top frame member extending above the height of said lintel.

16. The fireplace of claim 15, said insert assembly further comprising:

a heat exchange passageway for conducting air from the vicinity of said base and along at least one outer wall of said firebox, and having an outlet defined between said top and a top panel mounted in spaced relationship to said top; and a guide plate for guiding in a forward direction air exiting said outlet, said guide plate being removably attached to said top panel.

17. The fireplace of claim 15, said insert assembly further comprising:

at least two contrasting colors inside said insert assembly; and a dark color applied to the inside of said hearth.

18. The fireplace of claim 16, said insert assembly further comprising:

at least two contrasting colors inside said insert assembly; and a dark color applied to the inside of said hearth.

19. The fireplace of claim 17, wherein said contrasting colors comprise a dark color and a light color.

20. The fireplace of claim 19 wherein:

said at least one wall has a rear portion and side portions having a dark color and a contrasting light color, said light color extending downward from a demarcation between said dark and said light colors to said base; and said demarcation being continuous across said rear and said side portions.

21. The fireplace of claim 20 wherein said dark color is further applied to said legs and to all outer surfaces of said insert assembly.

22. The fireplace of claim 21, further comprising a decorative fender inside said hearth, between said insert assembly and said mouth.

23. The fireplace of claim 22 wherein said decorative fender is unsupported by said insert assembly.

24. The fireplace of claim 18, wherein said contrasting colors comprise a dark color and a light color.

25. The fireplace of claim 24 wherein:

said at least one wall has a rear portion and side portions having a dark color and a contrasting light color, said light color extending downward from a demarcation between said dark and said light colors to said base; and said demarcation being continuous across said rear and said side portions.

26. The fireplace of claim 25 wherein said dark color is further applied to said legs and to all outer surfaces of said insert assembly.

27. The fireplace of claim 26, further comprising a decorative fender inside said hearth, between said insert assembly and said mouth.

28. The fireplace of claim 27 wherein said decorative fender is unsupported by said insert assembly.

* * * * *